US012715661B2

(12) United States Patent
Chisholm

(10) Patent No.: US 12,715,661 B2
(45) Date of Patent: Aug. 25, 2026

(54) FLEXIBLE CLOSURE AND PACKAGE INCLUDING A FLEXIBLE CLOSURE

(71) Applicant: Owens-Brockway Glass Container Inc., Perrysburg, OH (US)

(72) Inventor: Brian Chisholm, Evanston, IL (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 15 days.

(21) Appl. No.: 18/199,676

(22) Filed: May 19, 2023

(65) Prior Publication Data

US 2023/0373692 A1 Nov. 23, 2023

Related U.S. Application Data

(60) Provisional application No. 63/421,282, filed on Nov. 1, 2022, provisional application No. 63/344,356, filed on May 20, 2022.

(51) Int. Cl.

| | |
|---|---|
| ***B65D 43/02*** | (2006.01) |
| ***B65D 1/10*** | (2006.01) |
| ***B65D 51/16*** | (2006.01) |

(52) U.S. Cl.

CPC ..... *B65D 43/0208* (2013.01); *B65D 1/10* (2013.01); *B65D 51/1688* (2013.01); *B65D 2543/00092* (2013.01); *B65D 2543/00296* (2013.01); *B65D 2543/005* (2013.01); *B65D 2543/00537* (2013.01); *B65D 2543/00555* (2013.01); *B65D 2543/00648* (2013.01); *B65D 2543/00685* (2013.01); *B65D 2543/0074* (2013.01); *B65D 2543/00796* (2013.01)

(58) Field of Classification Search

CPC ..... B65D 5/746; B65D 35/42; B65D 43/24; B65D 47/141; B65D 55/16; B65D 2251/1008; B29C 45/14; B29L 2031/712

See application file for complete search history.

(56) References Cited

U.S. PATENT DOCUMENTS

| | | | | |
|---|---|---|---|---|
| 2,953,272 | A * | 9/1960 | Mumford | B65D 41/185 215/320 |
| 3,116,846 | A | 1/1964 | Salminen | |
| 3,189,234 | A | 6/1965 | Thomson | |
| 3,209,934 | A | 10/1965 | Salminen | |
| 3,295,711 | A * | 1/1967 | Abrams | B67B 3/22 220/792 |
| 3,297,184 | A * | 1/1967 | Andelin | B65D 41/023 215/320 |

(Continued)

FOREIGN PATENT DOCUMENTS

| | | | |
|---|---|---|---|
| DE | 20120906 | U1 | 5/2002 |
| WO | 0162837 | A2 | 8/2001 |
| WO | 2019201967 | A1 | 10/2019 |

OTHER PUBLICATIONS

PCT Search Report and Written Opinion, Int. Serial No. PCT/US2023/023029, Int. Filing Date: May 19, 2023, Applicant: Owens-Brockway Glass Container Inc., Date: Sep. 18, 2023.

(Continued)

*Primary Examiner* — James N Smalley

(57) ABSTRACT

A closure for a container includes a radially extending elastomeric bead that is pressed against a sealing surface of the container when coupled with the container.

18 Claims, 4 Drawing Sheets

(56) References Cited

U.S. PATENT DOCUMENTS 3,298,415 A * 1/1967 Klygis ..... B65D 43/0208 215/320
3,300,073 A * 1/1967 Benz ..... B65D 41/48 215/256
3,330,433 A 7/1967 Salminen
3,381,872 A * 5/1968 Holder ..... B65D 51/1666 220/785
3,692,208 A * 9/1972 Croyle ..... B65D 43/0204 220/233
3,817,420 A 6/1974 Heisler
3,825,144 A * 7/1974 Wiedmer ..... B65D 41/185 215/320
3,842,790 A * 10/1974 Clark ..... B67B 7/02 215/296
4,206,852 A * 6/1980 Dunn ..... B65D 41/3466 215/354
4,307,817 A * 12/1981 Cotroneo ..... B65D 43/021 215/DIG. 1
4,487,326 A 12/1984 Uhlig
4,546,085 A * 10/1985 Johansson ..... B65D 41/0414 422/561
4,610,372 A * 9/1986 Swartzbaugh ..... B65D 41/0428 220/288
4,674,644 A * 6/1987 Jacobs ..... B65D 43/0212 215/320
5,288,466 A * 2/1994 Burns ..... A61B 5/150343 215/354
5,460,283 A * 10/1995 MaCartney ..... B65D 41/185 215/354
5,672,321 A * 9/1997 Daykin ..... A61J 1/1418 215/354
7,261,216 B2 * 8/2007 Becker ..... B65D 47/122 215/44
8,070,012 B2 12/2011 Alvares et al.
8,083,086 B2 12/2011 Alvares
8,172,101 B2 * 5/2012 Giusti ..... B01L 3/50825 220/255
8,459,486 B2 6/2013 Luburic et al.
11,498,722 B2 * 11/2022 Reynolds ..... B65D 25/06
2006/0151511 A1 * 7/2006 Kaposi ..... B65D 43/022 220/573.1
2013/0186898 A1 7/2013 Luburic et al.
2019/0283937 A1 9/2019 Selina et al.

OTHER PUBLICATIONS

Chilean Informe De Busqueda (Search Report), Application No. 202403496, Applicant: Owens-Brockway Glass Container Inc., Dated: Mar. 31, 2026.
Chilean Inform Pericial (Expert Report), Application No. 202403496, Applicant: Owens-Brockway Glass Container Inc., Dated: Mar. 31, 2026.

* cited by examiner

FLEXIBLE CLOSURE AND PACKAGE INCLUDING A FLEXIBLE CLOSURE

TECHNICAL FIELD

This patent application discloses innovations related to closable containers and, more particularly, to closures for closable containers.

BACKGROUND

Many types of containers include a base, a body extending away from the base, and a finish for accepting a closure. The finish typically includes circumferentially extending threads to cooperate with corresponding features of the closure, and a circular axial end surface to cooperate with a seal on an undersurface of the closure. U.S. Pat. No. 2,244,316 illustrates a glass container and closure of this type.

Other types of containers may be closed with peelable foil closures, such as foil caps. Such caps typically include a circular base wall and a skirt extending axially from the base wall. A foil cap is typically applied to the finish of a container such that the base wall covers a circular opening of the finish and the skirt extends along radially outer surfaces of the container finish. The base wall may be adhered to top sealing surface of the container. U.S. Pat. No. 10,414,524 illustrates a glass container and closure of this type that together form a foil seal-to-glass (FSTG) package. FSTG packaging requires specialty adhesive material as well as specialized equipment to vapor coat critical surfaces of the container.

SUMMARY OF THE DISCLOSURE

The present disclosure embodies a number of aspects that can be implemented separately from or in combination with each other.

In accordance with one aspect of the disclosure, there is provided a closure for a container that includes a radially extending elastomeric sealing bead that is pressed against a sealing surface of the container when coupled with the container.

In accordance with one aspect of the disclosure, there is provided a closure for a container having a radially inward facing sealing surface. The closure includes a main wall extending radially outward from a center of the closure, an annular flange located radially outward of the main wall, and a sealing portion located radially between the main wall and the annular flange. The annular flange is configured to cover at least a portion of a finish of the container when the closure is installed on the container, and the sealing portion includes an elastomeric bead that forms a seal with the sealing surface of the container when installed on the container.

DETAILED DESCRIPTION

Described below is a closure configured to reversibly seal a container without the need for a threaded portion on the container or the closure. The closure may be manually removed in a manner similar to a peel-off closure but can be re-installed to reliably close the container again. The closure may include a radially extending elastomeric bead or lip that forms a liquid-tight seal with a surface of the container.

Figure 1:
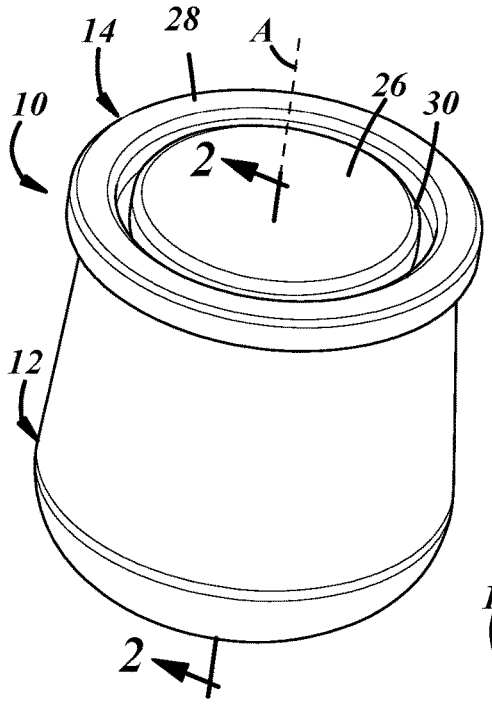
FIG. 1 is a perspective view of a package including a container and a closure in accordance with an illustrative embodiment of the present disclosure.
Figure 2:
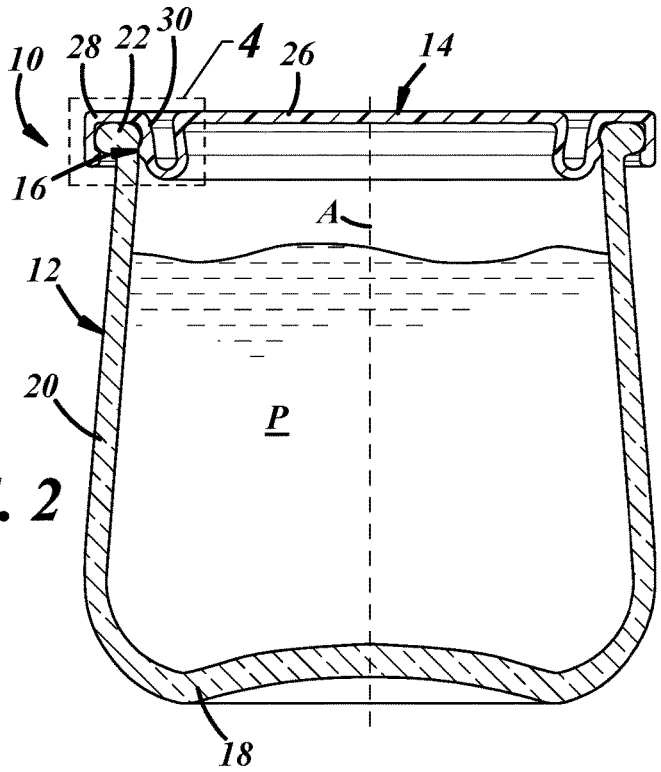
FIG. 2 is a cross-sectional view of the package of FIG. 1.

With specific reference to the drawing figures, FIGS. 1 and 2 show an illustrative embodiment of a package 10 that includes a container 12 and a closure 14. The package 10 can embody the peelable functionality of an FSTG package without the need for adhesives, heat sealing, welding, or other secondary attachment processes, and without specialty coatings on the container 12. Additionally, the closure 14 can be made to embody the reusable nature of a threaded closure without employing threads, such that the package 10 is resealable for reuse after its initial contents are accessed.

The closure 14 is removably coupled to the container 12 to form a liquid-tight seal 16 when the package 10 is in the closed condition of FIGS. 1 and 2. As used herein, "removably coupled" means that a user may peel off or otherwise manually decouple the closure 14 from the container 12 to open the package 10 and gain access to its contents without using a bottle opener, can opener, or other tool. Removal of the illustrated closure 14 can also be non-destructive—i.e., completed without damaging the container, closure, or any other attachment feature (e.g., adhesive bond, snap tabs, etc.). The package 10 may be a food package used to contain yogurt, fruit sauce, pudding, or any other food or beverage product P. The package 10 may alternatively be used to contain other types of products including but not limited to liquids, gels, powders, particles, and the like. The package 10 has an axis A about which the container 12 and/or closure 14 may have rotational symmetry. The axis A lies in a plane with respect to which the container 12 and/or closure 14 may have mirror symmetry. The container 12, closure 14, and/or package 10 may also be non-symmetric.

Figure 3:
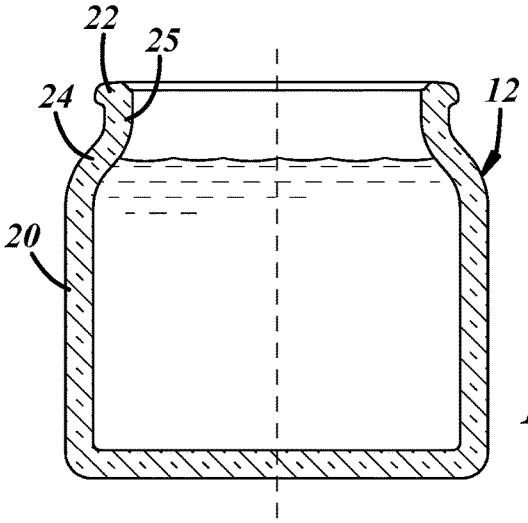
FIG. 3 is a cross-sectional view of another container for use with the closure of FIGS. 1 and 2.

The container 12 may be formed from glass, metal, plastic, or any other material suitable for containing the types of products listed above. In one embodiment, the container is formed from a rigid material such as glass, metal, or ceramic. In a particular embodiment, the rigid material is glass. The illustrated container 12 includes a base 18, a body 20 extending away from the base 18, and a finish 22 terminating the body 20 and configured for accepting the closure 14. In some embodiments, the body 20 of the container 12 includes one or more distinguishable contours or other features between the base 18 and the finish 22, such as a shoulder 24 and/or a neck 25, as in the example of FIG. 3.

The illustrated closure 14 includes a circular main wall 26 extending radially outward from a center of the closure through which the longitudinal axis A extends, an annular flange 28 extending over and along the finish 22 and positioned radially outward of the main wall 26, and a sealing portion 30 interconnecting the main wall 26 and annular flange 28. The closure 14 may include or may be formed from a polymer-based material, such as a plastic, an elastomer, or a polymer composite material. In one embodiment, the polymer-based material is an elastomer, such as a rubber-based material or a thermoplastic elastomer (TPE). In a particular embodiment, the elastomer is a TPE. The closure 14 may be monolithic—i.e., formed as a single, molecularly continuous piece from a single material formulation, such as by injection molding, or it may be formed from multiple pieces that are affixed together. The entire closure 14 is preferably formed from the polymer-based material. In other embodiments, however, only a portion of the closure 14 is formed from the polymer-based material. For example, a portion of the closure 14 at the liquid-tight seal 16 may include or be formed from an elastomer while other portions of the closure are formed from a different material. In another example, the sealing portion 30 of the closure 14 is formed from an elastomer while other portions of the closure are formed from a different material.

Figure 4:
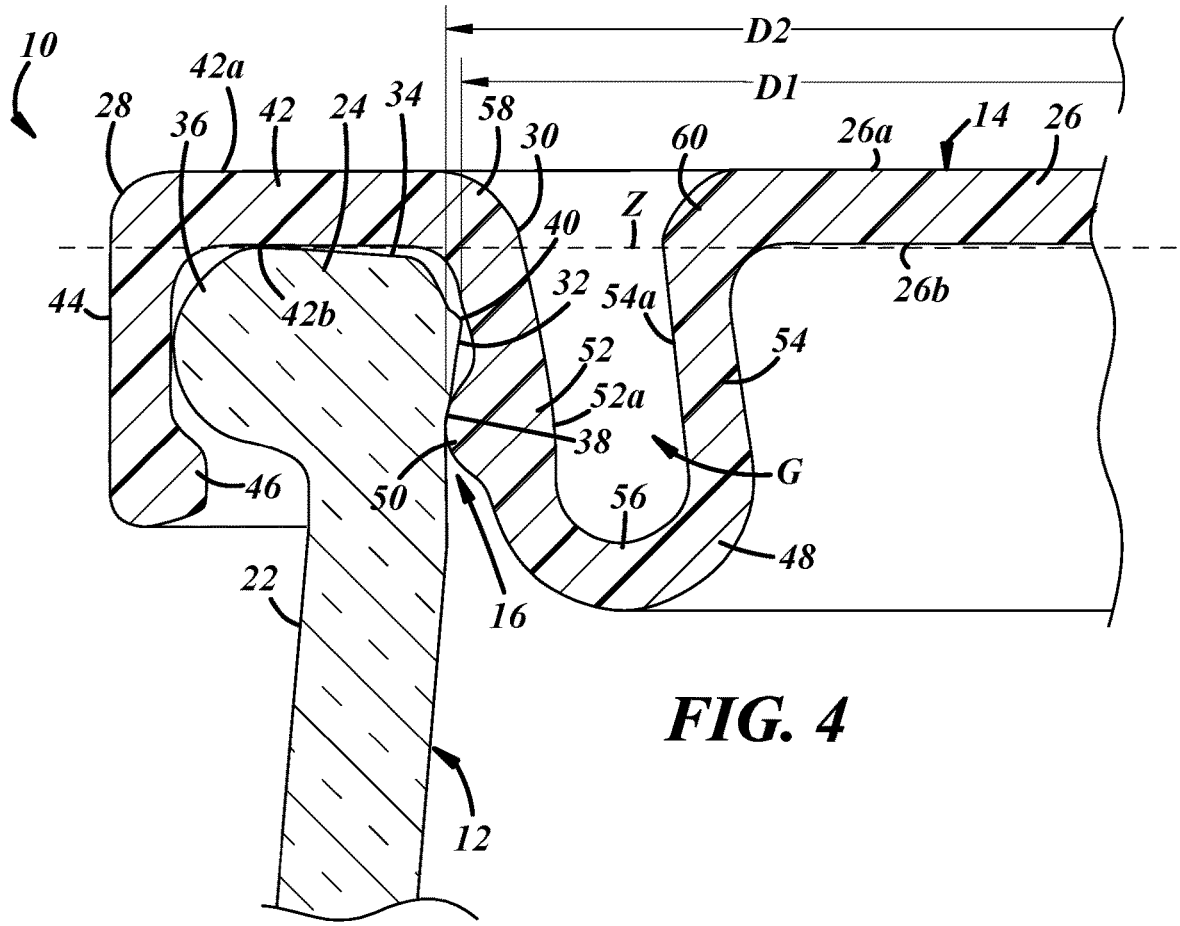
FIG. 4 is an enlarged view of a portion of FIG. 2.

FIG. 4 is an enlarged view of a portion of FIG. 2 illustrating the previously mentioned features in further detail. The finish 22 of the container 12 includes an open mouth 32 surrounded by an axial end surface 34 and a retention flange 36 that projects radially outward from the body 20. The finish 22 includes a sealing surface 38 facing in a predominantly radially inward direction, for example forming an angle of less than 45 degrees with the axis A and preferably forming an angle of less than 30 degrees or less than 15 degrees with the axis A. The sealing surface 38 is annular and is a pristine surface, meaning it is a circumferentially continuous and smooth surface along its entire annular and axial extents. Here, "continuous and smooth" means without any radially inward or outward deviations that could prevent formation of the liquid-tight seal 16. Where the container 12 is a molded product, the pristine surface has no witness line or mark from a mold parting line, for example. The inwardly facing surface of a blow molded container 12 is a surface not formed against a blow mold surface and is an example of a pristine surface.

The sealing surface 38 is axially spaced from the axial end surface 34 and is adjacent a radially inwardly extending bead 40, in this example. The bead 40 may be an artifact of the container manufacturing process due to part-to-part variations in container wall thickness and/or the size and design of the container mold, for example, and is not always present. This inconsistent presence and size of the bead 40 can cause variation in a minimum internal diameter D1 of the mouth 32 of the container 12, which the closure 14 is useful to accommodate.

In some embodiments, the container 12 is a wide-mouth container. As used herein, "wide-mouth" refers to a mouth 32 having a minimum internal diameter D1 sufficiently large to fit an average-sized teaspoon through to retrieve contents from the container 12, which is about 30 mm. In some embodiments, the minimum internal diameter D1 is greater than or equal to 50 mm. In some embodiments, the mouth 32 is characteristic of a food container, and the container 12 is not a beverage container. In various embodiments, the minimum internal diameter of the mouth 32 is in one of the following ranges: 30 mm to 300 mm, 40 mm to 200 mm, 50 mm to 150 mm, 60 mm to 125 mm, 70 mm to 100 mm, 80 mm to 90 mm, and any combination of endpoints of these ranges. There is no practical maximum diameter for the mouth 32 of the container 12. An inner diameter D2 of the sealing surface 38 is also depicted in FIG. 4.

The annular flange 28 of the closure 14 includes a radially extending base wall 42, an axially extending skirt 44 depending downwardly from the base wall 42, and a radially inwardly extending lip 46 that protrudes inwardly from the axially extending skirt 44 and is axially displaced from the base wall 42. The main wall 26 of the closure 14 and the base wall 42 of the annular flange 28 may be coplanar in that both walls 42, 26 extend symmetrically along the same geometric plane within normal manufacturing tolerances. Additionally, the main wall 26 and the base wall 42 may have corresponding upper and lower surfaces 26*a*, 26*b*, 42*a*, 42*b* that may be coplanar in that each of the upper surfaces 26*a*, 42*a* and the lower surfaces 26*b*, 42*b* lie in corresponding geometric planes within normal manufacturing tolerances. The axially extending skirt 44 may extend in a perpendicular direction with respect to the main wall 26 and the base wall 42 of the annular flange 28, but such perpendicularity is not necessarily required as the skirt 44 may, in some instances, be biased radially inwardly or radially outwardly by up to 30° from the perpendicular direction.

The base wall 42 covers the axial end surface 34 of the finish 22, and the skirt 44 covers the flange 36 of the finish 22. An axial datum Z may be defined at the interface between the base wall 42 and the axial end surface 34 where the closure 14 bottoms out on the container 12. The axial distance between the datum Z and the lip 46 and the radial dimension of the lip are selected such that the annular flange 28 of the closure 14 wraps around the retention flange 36 of the container 12 such that the lip 46 and retention flange cooperate to help retain the closure to the container at or near their respective perimeters. A radial gap between the lip 46 and the body 20 or finish 22 provides a location along which a user can place their fingertips to peel the closure 14 away from the container 12.

The sealing portion 30 of the closure 14 includes a compliant portion 48 and a sealing bead 50 protruding radially outwardly from the compliant portion toward the sealing surface 38 of the container 12. The compliant portion 48 is configured to deflect radially inward during installation on the container 12 and to press the sealing bead 50 against the sealing surface 38 of the container when coupled with the container. As with the sealing surface 38 of the container, the sealing bead 50 may have a pristine surface along its entire annular and axial extents. The compliant portion 48 functions in the manner of a spring with sufficient stiffness to ensure that the sealing bead 50 is biased against the sealing surface 38 of the container 12 in a minimum interference condition and with sufficient compliance to enable the sealing bead 50 to move radially inward enough to move past the any radial bead 40 at the mouth 32 of the container 12 when the closure 14 is being coupled with or decoupled from the container 12. In the minimum interference condition, the radial dimensions of the container 12 are at their maximum tolerance and the radial dimensions of the closure 14 are at their minimum tolerance. In the maximum interference condition, the radial dimensions of the container 12 are at their minimum tolerance and the radial dimensions of the closure 14 are at their maximum tolerance.

In a comparative example in which the container is a glass container and the closure is a plastic plug-style closure, the tolerance range on a nominal 66 mm (2.6") container is about ±0.6 mm (±0.023"), while the tolerance range on the same size closure is about ±0.2 mm (±0.007"). With the container 12 at its largest and the closure at its smallest, there would be a gap of about 0.75 mm (0.030") between the intended sealing surfaces and, thus, effectively no seal. Conversely, with the container 12 at its smallest and the closure at its largest, there would be an interference of about 0.75 mm (0.030") between the intended sealing surfaces, which is an impractical amount of interference for a plastic plug-style closure to fit into the neck of the container.

The illustrated closure 14 addresses these and other problems via inclusion of the compliant portion 48 and appropriate material selection for the sealing portion 30. The illustrated compliant portion 48 of the sealing portion 30 has a cross-section that is U-shaped with a first wall 52 carrying the sealing bead 50, a second wall 54 substantially parallel with the first wall 52, and a connector wall 56, which may be rounded or angled, for example, that interconnects the first and second walls 52, 54 and spans a radial gap therebetween. Here, "substantially parallel" includes "true parallel" and up to 10 degrees away from true parallel. The first wall 52 has a first wall thickness and is joined with the base wall 42 of the annular flange 28 at a first transition region 58, and the second wall 54 has a second wall thickness and is joined with the radially extending wall 26 at a second transition region 60, each of which includes a generous radius. Other cross-sectional shapes are possible, such as a V-shape, an S-shape, a serpentine shape, or an accordion shape, each of which includes at least two axially extending walls having portions separated from one another by a radial gap. The connector wall 56 has a connector wall thickness and may be a continuously curving bight having corresponding internal and external radii.

The sealing portion 30 may depend downwardly from the annular flange 28 and the main wall 26 of the closure 14. The first wall 52 of the compliant portion 48 depends axially or downwardly from the base wall 42 of the annular flange 28 and the second wall 54 depends axially or downwardly from the main wall 26, and the sealing bead 50 projects radially outwardly from the first wall 52 by a distance, which may be equal to or greater than 50% of the first wall thickness of the first wall 52. The main wall 26, the base wall 42, the first wall 52, and the second wall 54 may all have the same wall thickness, but this is not necessary. Depending on various factors such as the size and shape of the container 14 and the specific construction of the closure 12, the sealing portion 30 of the closure 14 may extend downwardly beyond the radially inwardly extending lip 46 of the annular flange 28 or the lip 46 may be displaced axially downwardly beyond the sealing portion 30.

Moreover, axial support structures located between the first wall 52 and the second wall 54 of the compliant portion 48 are not needed and, thus, are not present in the embodiment shown here, and both a radially inwardly facing surface 52*a* of the first wall 52 and a radially outwardly facing surface 54*a* of the second wall 54 may be smooth and therefore free of stiffening ribs or projections along their full annular extents. The first and second walls 52, 54 of the compliant portion 48 oppose each other across an annular gap G, and the annular gap has an open cross-section along an its entire annual extent—that is, there are no radial ribs interconnecting the opposing surfaces 52*a*, 54*a* of the walls 52, 54. Further, the compliant portion 48 and the annular gap G may together have a uniform cross-section along their entire annular extents with no stiffening features along any of the surfaces of the compliant portion.

Figure 5:
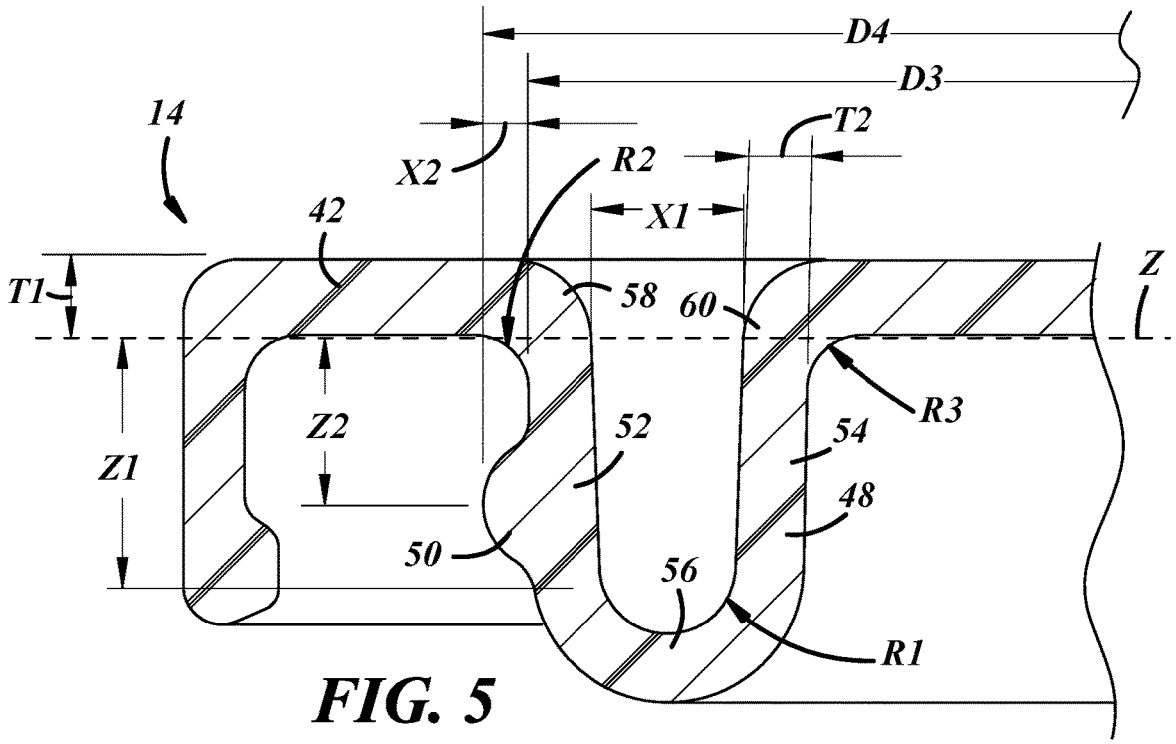
FIG. 5 is a cross-sectional view of the same portion of the closure of FIG. 4 with the closure in a free state.

FIG. 4 depicts the container 12 and closure 14 in the maximum interference condition, which causes the compliant portion 48 to be deflected away from a free state and radially toward the axis A of the package 10. FIG. 5 depicts the same portion of the closure 14 of FIG. 4 in the free state when decoupled from the container 12. The radial deflection of the compliant portion 48 is facilitated by elastic deformation of the closure 14, primarily at the first and second transition regions 58, 60 and, to some degree, elastic deformation at the connector 56 and along the first wall 52 opposite the sealing bead 50.

The stiffness and, conversely, the compliance of the compliant portion 48 can be tailored via its geometry and via the properties of the material from which the compliant portion is made. Some dimensions that can affect the stiffness of the compliant portion 48 are illustrated in FIG. 5, including the wall thickness T1 of the main wall 26 and/or the base wall 42, the wall thicknesses T2 of the first and second walls 52, 54 of the compliant portion 48, the radial distance X1 between the first and second walls 52, 54 of the compliant portion 48, the axial length Z1 of the first and second walls 52, 54 of the compliant portion 48, and respective radii R1-R3 of the connector 56 and the transition regions 58, 60. The radii R1-R3 are internal radii in this example, but the corresponding external radii have the same or similar effect on the function of the compliant portion 48. Generally, the stiffness of the compliant portion 48 will increase with increasing wall thicknesses T1, T2 and with decreasing wall length Z1. Other dimensions labelled in FIG. 5 include an outer diameter D3 of the first wall 52 of the compliant portion 48, an outer diameter D4 of the sealing bead 50, and an axial distance Z2 from the datum Z to the axial center of the sealing bead 50. Diameters D3 and D4 determine the radial dimension X2 of the sealing bead 50. In various embodiments, the radial dimension X2 of the sealing bead 50 (i.e., one-half of D4-D3) is greater than the radial dimension of the inwardly extending bead 40 of the container, which is one-half of D2-D1, or (D4-D3)>(D2-D1). More precisely, X2 should be greater than the radial dimension of the inwardly extending bead 40 of the container when X2 is at its minimum tolerance condition and the bead 40 is at its maximum tolerance condition.

In this embodiment, and as depicted in FIG. 5, the wall thicknesses T1 of the main wall 26 and the base wall 42 of the annular flange 28 are a first common wall thickness, exclusive of the thickness of the sealing bead 50, and the first and second wall thicknesses T2 of the first and second walls 52, 54 of the compliant portion 48 of the sealing portion 30 are a second common wall thickness that is less than the first common wall thickness T1. Also in this embodiment, when the closure is in a free state, the first wall 52 of the compliant portion 48 extends axially downwardly and radially inwardly from the base wall 42 of the annular flange 28 while the second wall 54 of the compliant portion 48 extends axially downwardly and radially outwardly from the main wall 26 such that the first wall 52 and the second wall 54 diverge from one another as the two walls 52, 54 extend away from the connector wall 56. These conditions are not mandatory structural constraints of the closure 14 but, rather, represent one possible option for helping attain the desired stiffness of the compliant portion 48 of the sealing portion 30 of the closure 14 for use with the container 12 in the manner described herein. The closure 14 may assume other structural configurations that do not satisfy the wall thickness and angular conditions just mentioned.

The dimensions listed in TABLE I are believed to be sufficient for proper function of the closure 14 throughout the range between the minimum and maximum interference conditions where the closure is of monolithic construction and molded from an elastomer.

TABLE I

| | Dimension | Tolerance Range |
|---|---|---|
| D2 | 56.1 mm (2.21") | 55.47-56.6 mm (2.184-2.230 in.) |
| D3 | 55.9 mm (2.20") | |
| D4 | 57.4 mm (2.26") | 57.15-57.65 mm (2.250-2.270 in.) |
| X1 | 2.8 mm (0.11") | |
| X2 | 0.9 mm (0.035") | |
| Z1 | 4.3 mm (0.17") | |
| Z2 | 3.0 mm (0.12") | |
| T1 | 1.5 mm (0.06") | |
| T2 | 1.3 mm (0.05") | |
| R1 | 1.3 mm (0.05") | |
| R2 | 1.0 mm (0.04") | |
| R3 | 1.0 mm (0.04") | |

The closure is designed to have a minimum interference condition ($D4_{min}$-$D2_{max}$) of 0.25 mm (0.010") per side, or 0.50 mm (0.020") on the diameter, and a maximum interference condition ($D4_{max}$-$D2_{min}$) of 1.09 mm (0.043") per side, or 2.18 mm (0.086") on the diameter. These dimensions are only illustrative, as the actual working dimensions may vary depending on the closure material, the overall container size, manufacturing process parameters, and other variables. The minimum interference condition should be selected so that the closure 14 remains attached to the container 12 with the liquid-tight seal 16 intact when the closed package 10 is inverted with the contents P resting on the inner surface of main wall 26 of the closure 14. The friction between the container 12 and the closure 14 at the seal 16, cooperation of the radial lip 46 with the retention flange 36, and the stiffness of the compliant portion 48 all contribute to the necessary resistance to enable this functionality, and one or more of those features can be tailored to obtain the functionality. For example, the radial dimension of the lip 46 of the annular flange 28 may be increased to provide more robust retention of the closure. The relatively high static coefficient of friction of an elastomeric sealing bead 50 against the sealing surface 38 can also positively contribute to retention of the closure 14 on the container 12.

Suitable materials for the main wall 26, the annular flange 28, the sealing portion 30, the compliant portion 48, the sealing bead 50, and/or the entire closure 14 include elastomeric materials. As used herein, the terms "elastomer" and "elastomeric" are assigned their ordinary and customary meaning to a person of ordinary skill in the art at the time the present application is filed. Elastomers include thermoset materials (e.g., vulcanized natural rubber or silicone rubber) and thermoplastic materials (TPEs). TPEs may be preferred due to the economics of injection molding and the ability to tailor their mechanical properties. Elastomers are characterized by high elastic deformability and a low modulus of elasticity compared to other polymer-based materials and typically have a glass transition temperature well below room temperature and usually well below 0° C.

In various embodiments, at least the sealing bead 50 and up to the entire closure 14 is made from a TPE. Suitable TPEs include elastomers based on a styrenic block copolymer (TPS), thermoplastic olefin (TPO), thermoplastic vulcanizate (TPV), thermoplastic polyurethane (TPU), thermoplastic copolyester (TPC), or thermoplastic polyamide (TPA). In some applications, such as food packaging, the polymer-based material has a GRAS (Generally Recognized As Safe) designation according to U.S. Food & Drug Administration guidelines for food contact articles. GRAS styrenic block copolymer elastomers and GRAS TPO elastomers may be preferred. Block copolymer TPEs can be tailored to specific applications via the ratio of high $T_g$ component (e.g., styrene) to low $T_g$ component (e.g., elastomer). For example, in refrigerated or frozen food applications, the overall $T_g$ can be tailored to ensure elasticity and pliability at those temperatures, while another TPE in the same family can be made more rigid in higher temperature applications. TPOs are based on olefins all of which have low $T_g$ values and can be very cost-effective. In one embodiment, the elastomeric material has a Shore A durometer in a range from 50 to 100, 55 to 95, 60 to 90, 65 to 85, 60 to 80, 65 to 75, 70 to 80, or any combination of endpoints of those ranges, including the endpoints of the range, when subjected to the ASTM 2240-15 (2021) Durometer Hardness Test. Several examples of elastomers falling within and near these ranges are commercially available under the tradename Versaflex, including, for example, the Versaflex™ FFC line of products.

The durometer may be tailored to balance competing material properties such as flexibility versus the capacity to form an hermetic seal. For example, a more flexible (lower durometer) material can better simulate a "peel-off" function and is more likely to form a robust seal due to its ability to easily conform to the shape of the container at the sealing surface and its relatively high coefficient of friction to maintain the seal. However, some of these beneficial properties may have unwanted effects, such as entrapment of air in the container while installing the closure on the container (due to the seal forming before the closure is fully seated) and a resulting internal pressure tending to force the closure off of the container. A less flexible (higher durometer) material may have less of a tendency to quickly form a seal during installation, which can alleviate problems with entrapped gas but may also form a lower friction and/or less conforming seal. Durometer adjustments can be made by adding a compatible non-elastomeric plastic to the elastomeric compound. A polypropylene copolymer, for example, may be blended with an olefin-containing elastomer to increase the durometer of the elastomer. A preferred Shore A durometer may be in a range from 70-90.

FIGS. 6-9 show another illustrative embodiment of the closure 14. This embodiment is similar in many respects to the embodiment of FIGS. 1-5, and like numerals among the embodiments generally designate like or corresponding elements throughout the several views of the drawing figures. Accordingly, the descriptions of the embodiments are incorporated into one another, and description of subject matter common to the embodiments generally may not be repeated here.

Figure 6:
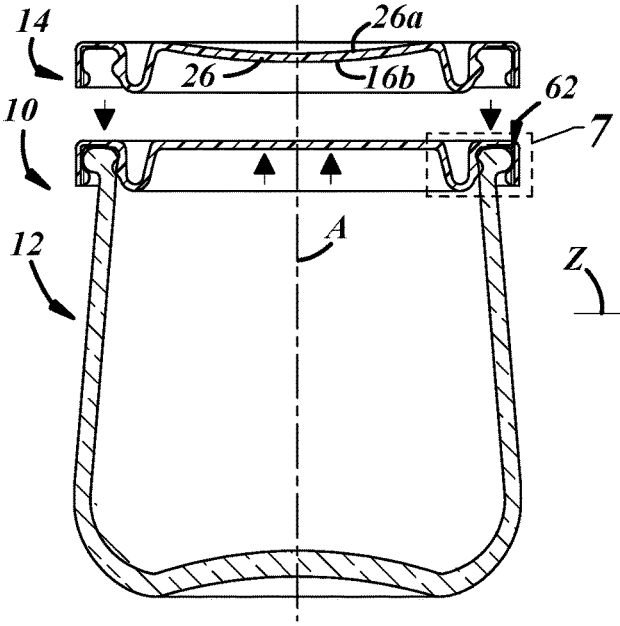
FIG. 6 is a cross-sectional view of the container of FIG. 1 with another embodiment of the closure.

In the embodiment of FIGS. 6-9, the closure 14 is generally the same as in the previous figures except for the shape of the main wall 26 and/or the inclusion of one or more vents 62 along an underside 64 of the closure 14. FIG. 6 illustrates the closure 14 both uncoupled from the container 12 and coupled with the container 12. In the uncoupled and free state, surfaces of the main wall 26 are non-planar. The upper surface **26*a* of the main wall 26 is concave or has a concave portion, and the lower surface 26*b* of the main wall is convex or has a convex portion. When the closure 14 is coupled with the container 12, any gas trapped in the resulting package 10 may act to reduce the degree of concavity of the upper surface 26*a* of the main wall 26 of the closure so that it is less concave, generally flat, or convex. Stated differently, the main wall 26 of the closure 14, when installed on the container 12, is deformed outwardly, relative to its free state, and away from the container. This functionality may be enabled by the flexible material from which the closure 14 is made. The flexibility and change in shape of the main wall 26** acts to reduce or relieve gas pressure in the closed container to effectively reduce forces acting to decouple the closure from the container.

Figure 7:
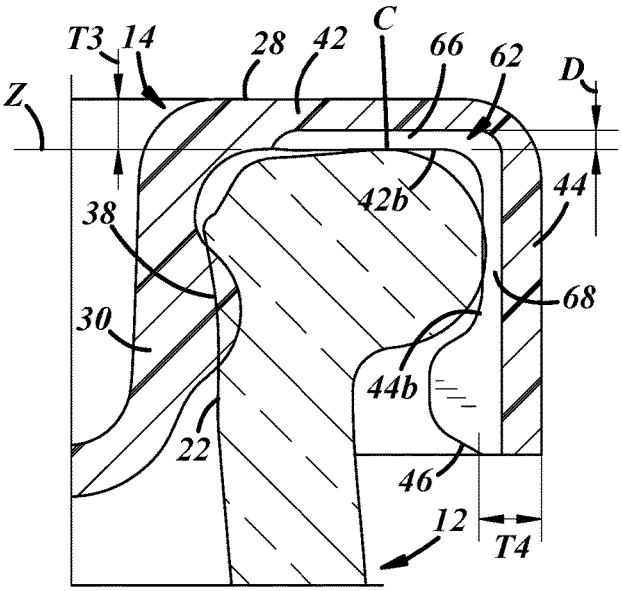
FIG. 7 is an enlarged view of a portion of FIG. 6.
Figure 8:
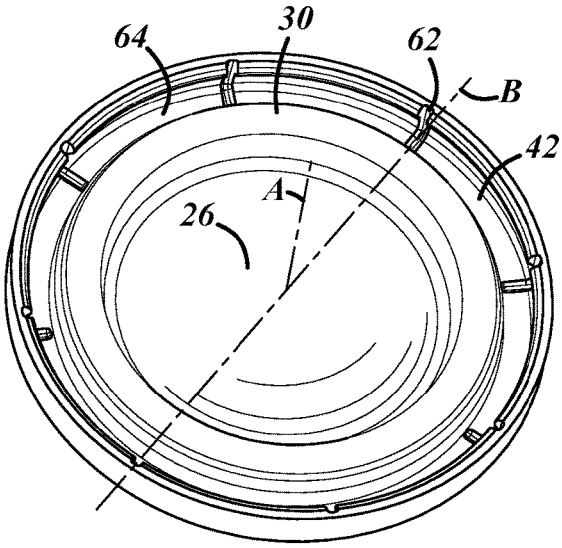
FIG. 8 is a perspective view of the underside of the closure of FIG. 6.

In another manner of addressing gas entrapment in the package 10 while installing the closure 14 on the container, one or more vents 62 may be included in the closure 14. In the example of FIG. 8, a plurality of vents 62 are provided along an underside 64 of the closure 14. Each vent 62 is configured to permit gas to escape from the space between the container 12 and the closure during installation on the container such that the vent is sealed off when the closure is coupled with the container. The illustrated closure 14 has eight vents 62 equally spaced about its annular flange 28. FIG. 7 is an enlarged cross-sectional view of one of the vents 62 with the closure 14 installed on the container 12. This particular depiction shows an amount of radial interference between the sealing surface 38 of the container 12 and the sealing portion 30 of the closure 14—i.e., the closure 14 is shown in its free state and superimposed on the container finish 22 in FIG. 7. It should be understood that the sealing portion 30 of the closure 14 will flex radially inward from the illustrated position when on the container 12.

Figure 9:
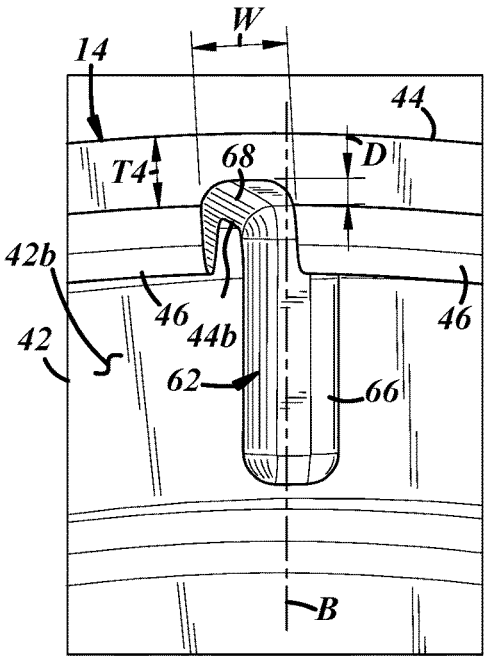
FIG. 9 is an enlarged view of a vent along the underside of the closure of FIGS. 6-8.

In this example, each vent 62 is formed along the annular flange 28 of the closure 14 and, in particular, along respective inner surfaces 42*b*, 44*b* of the base wall 42 and the axially extending skirt 44 of the annular flange 28. Each vent 62 is in the form of a recess or groove in the annular flange 28 where material is omitted from its otherwise continuous annular surfaces. Each vent 62 is symmetric with respect to the cross-sectional plane of FIG. 7, which is an axially and radially extending plane along the central axis A and a radial axis B (see FIG. 8). As shown in FIG. 9, each vent 62 has a uniform width W transverse to its plane of symmetry, excluding the radii at radial opposite ends of the vent.

Each vent 62 has a radial portion 66 formed in the base wall 42 of the annular flange 28 and an axial portion 68 formed in the axially extending skirt 44. The axial portion 68 also extends axially through the lip 46 of the annular flange 28 in this example. The radial and axial portions 66, 68 are interconnected where the base wall 42 and axially extending skirt 44 of the annular flange 28 meet. The radial portion 66 extends radially inward from the axial portion 64 at least part of the radial distance between the axially extending skirt and the sealing portion 30 of the closure 14. In this case, the radial portion 66 of the vent 62 extends most of that radial distance. In any case, the radial portion 66 may extend radially inward beyond a contact interface C between the container 12 and the inner surface 42*b* of the base wall 42 of the annular flange 28 at axial datum Z as illustrated in FIG. 7.

The depth D of each vent 62, as measured from the respective inner surfaces 42*b*, 44*b* of the base wall 42 and axially extending skirt 44, may be in a range from 10% to 50% of the thickness of the base wall 42 or skirt 44. The width W of each vent 62 may be in a range from 0.5 to 3 times the respective wall thickness T3, T4 of the base wall 42 and skirt 44, or greater than or equal to 0.5 times the respective wall thickness T3, T4 of the base wall and skirt with no practical limitation on maximum width. In this example the depth D is the same along both inner surfaces 42*b*, 44*b*, but this is not necessary.

FIG. 9 is an enlarged perspective view of one of the vents 62 as viewed from the underside of the closure 14 and is annotated with some of the same reference numerals as FIG. 7 to show the inner surface 42*b* of the base wall 42 of the annular flange 28 and the inner surface 44*b* of the axially extending skirt 44 with the radial and axial portions 66, 68 of the vent 62 formed therein.

Figure 10:
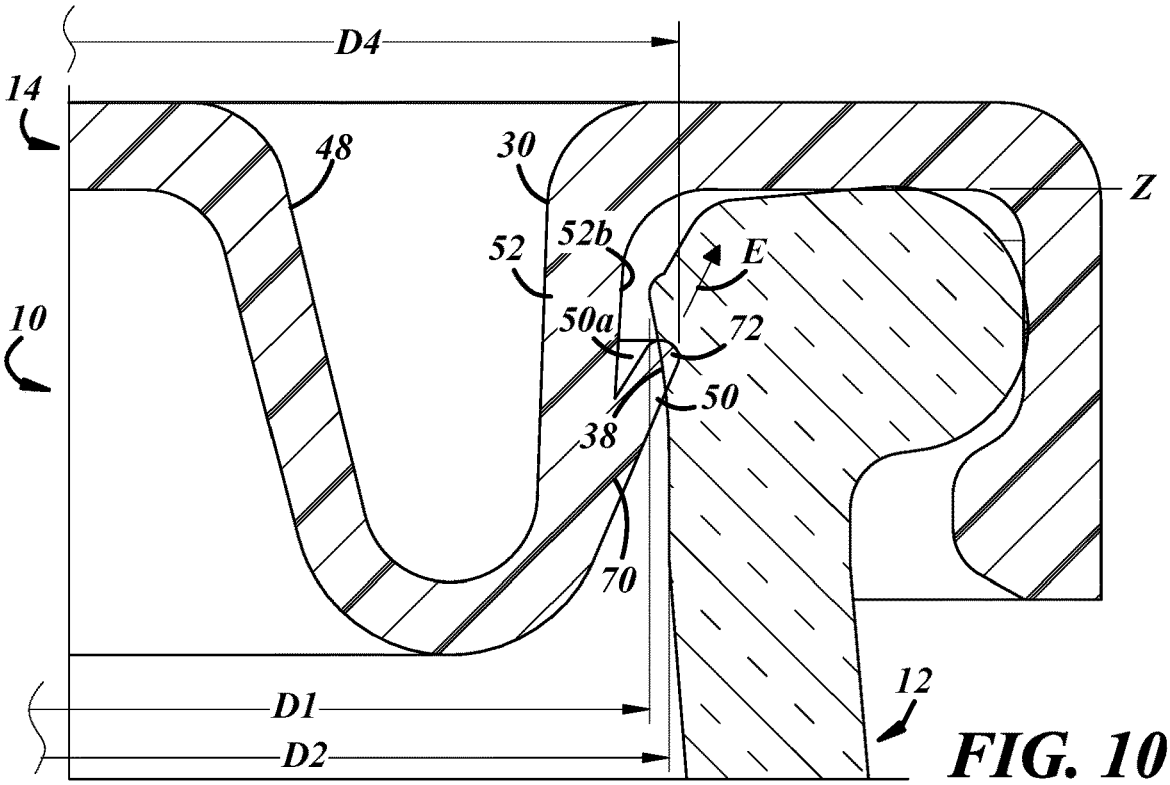
FIG. 10 is an enlarged cross-sectional view of a portion of another embodiment of the closure coupled with the container of FIG. 6.
Figure 11:
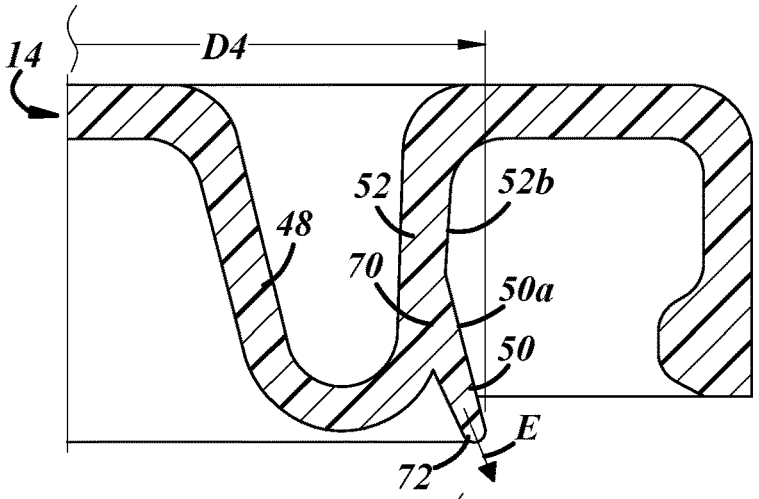
FIG. 11 is a cross-sectional view of the same portion of the closure of FIG. 10 with the sealing bead of the closure in a first position.
Figure 12:
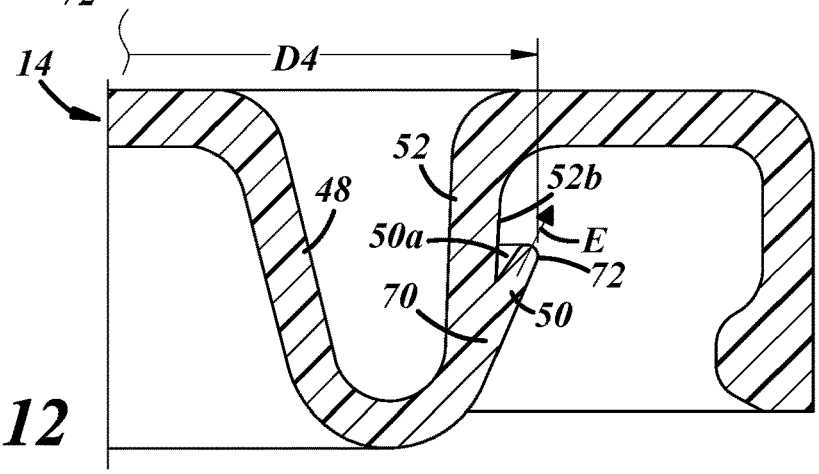
FIG. 12 is the view of FIG. 11 with the sealing bead in a second position.

FIGS. 10-12 show another illustrative embodiment of a closure. This embodiment is similar in many respects to the embodiment of FIGS. 1-9, and like numerals among the embodiments generally designate like or corresponding elements throughout the several views of the drawing figures. Accordingly, the descriptions of the embodiments are incorporated into one another, and description of subject matter common to the embodiments generally may not be repeated here.

FIG. 10 is an enlarged cross-sectional view of a portion of the closure 14 installed on the container 12 with a variation of the sealing portion 30. As with FIG. 7, this particular depiction shows an amount of radial interference between the sealing surface 38 of the container 12 and the sealing portion 30 of the closure 14—i.e., the closure 14 is shown in a free state and superimposed on the container finish 22 in FIG. 7. It should be understood that the sealing portion 30 of the closure 14 will flex radially inward from the illustrated position when on the container 12.

In the example of FIGS. 10-12, the sealing bead 50 is in the form of a bi-stable lip. The lip 50 is changeable between first and second stable positions as illustrated respectively in FIGS. 11 and 12. The lip 50 is in the first or downward stable position in FIG. 11 and in the second or upward stable position in FIG. 12. FIG. 11 depicts the lip 50 in an as-manufactured position of the closure 14, and FIG. 12 depicts the lip 50 in a use position. The lip 50 need not be bi-stable or may be more stable in one position (e.g., the upward position) than in the other position.

As in the previously described embodiments, the sealing bead 50 protrudes radially outwardly from the compliant portion 48 of the closure toward the sealing surface 38 of the container 12 and may have a pristine surface along its entire annular extent at least where it contacts the sealing surface 38 in its upward position. The sealing bead 50 projects radially outwardly from the first wall 52 of the compliant portion 48 by a distance which may be equal to or greater than 50% of the thickness of the first wall 52.

This variant of the sealing bead 50 has a direction of extension E that changes between its upward and downward positions. When in the downward position of FIG. 11, the direction of extension E has a radially outward component and an axially downward component. When in the upward position of FIG. 12, the direction of extension E has a radially outward component similar to that of the downward position and an axially upward component. The direction of extension E forms an angle between 20° and 30° with respect to vertical (i.e., parallel with axis A of the previous figures) in both the upward and downward directions, but its direction is reversed with respect to a horizontal plane, such as axial datum Z. Stated differently, an upper surface 50*a* of the sealing bead 50 forms an obtuse angle with a radially outward facing 52*b* of the first wall 52 of the compliant portion 48 of the closure 14 when in the downward position and forms an acute angle with the same surface 52*b* when in the upward position.

The cross-section of the illustrated sealing bead 50 has an elongate shape in the direction of extension E and extends from a base 70 at the radially outward facing surface 52*b* of the first wall 52 of the compliant portion 48 and tapers to a distal end 72. The base 70 of the sealing bead 50 may alternatively or additional extend along the connector 56 between the first and second walls 52, 54 of the compliant portion.

The outer diameter D4 of the sealing bead 50 is about the same in the upward and downward positions when not coupled with the container 12 and is greater than both the minimum internal diameter D1 of the container 12 and the inner diameter D2 of the sealing surface 38. While it is possible to install the as-manufactured closure 14 of FIG. 11 on the container 12 such that the sealing bead 50 changes from the downward position to the upward position during installation due to interference with the inner diameter D1 of the container, the sealing bead 50 is preferably changed to the upward position prior to installation on the container 12. When the closure 14 is installed with the sealing bead 50 in the upward position, it is deflected radially inward during installation and is biased radially outward. Moreover, any internal pressure created when an hermetic seal is formed before the closure 14 is fully seated on the container 12 can cause the upwardly positioned sealing bead 50 to deflect radially inward to release trapped gas, after which the radially outward bias presses the sealing bead against the inside of the container to reform the seal. The sealing bead 50 of FIGS. 10-12 is thus configured to vent entrapped gas in a manner that maintains a formed seal and that does not permit atmospheric gas from outside the closed container into the closed container, since trapped gas escapes only when the internal pressure of the container is higher than that of the surrounding atmosphere.

Other embodiments include one or more vents 62 along the underside of the closure 14 in addition to a dynamic sealing bead 50 with the configuration and/or functionality of the sealing bead of FIGS. 10-12. The concave feature of the main wall 26 of FIG. 6 may also be combined with one or both of the vents 62 and the dynamic sealing bead.

As used in herein, the terminology "for example," "e.g.," for instance," "like," "such as," "comprising," "having," "including," and the like, when used with a listing of one or more elements, is to be construed as open-ended, meaning that the listing does not exclude additional elements. Also, as used herein, the term "may" is an expedient merely to indicate optionality, for instance, of a disclosed embodiment, element, feature, or the like, and should not be construed as rendering indefinite any disclosure herein. Moreover, directional words such as front, rear, top, bottom, upper, lower, radial, circumferential, axial, lateral, longitudinal, vertical, horizontal, transverse, and/or the like are employed by way of example and not necessarily limitation.

Finally, the subject matter of this application is presently disclosed in conjunction with several explicit illustrative embodiments and modifications to those embodiments, using various terms. All terms used herein are intended to be merely descriptive, rather than necessarily limiting, and are to be interpreted and construed in accordance with their ordinary and customary meaning in the art, unless used in a context that requires a different interpretation. And for the sake of expedience, each explicit illustrative embodiment and modification is hereby incorporated by reference into one or more of the other explicit illustrative embodiments and modifications. As such, many other embodiments, modifications, and equivalents thereto, either exist now or are yet to be discovered and, thus, it is neither intended nor possible to presently describe all such subject matter, which will readily be suggested to persons of ordinary skill in the art in view of the present disclosure. Rather, the present disclosure is intended to embrace all such embodiments and modifications of the subject matter of this application, and equivalents thereto, as fall within the broad scope of the accompanying claims.

The invention claimed is:

1. A closure for a container, the closure comprising a radially extending elastomeric sealing bead that is pressed against a sealing surface of the container when coupled with the container, the closure further comprising a planar main wall, a compliant portion, and an annular flange the planar main wall extending radially outward from a center of the closure to the compliant portion, the compliant portion extending between the main wall and the annular flange, wherein the sealing bead extends radially from the compliant portion, the annular flange extending from the compliant portion and having a radially extending base wall, an axially extending skirt, and a lip protruding radially inwardly from the axially extending skirt, wherein a radial gap is defined between the lip and the container when the closure is coupled with the container, wherein the compliant portion comprises a first wall depending downwardly from the radially extending base wall of the annular flange, a second wall depending downwardly from the planar main wall and opposing the first wall across an annular gap, the first and second walls being interconnected by a connector wall spanning the annular gap between the first and second walls, wherein the elastomeric sealing bead extends radially outward from the first wall of the compliant portion, and wherein the main wall, compliant portion, and annular flange have a uniform wall thickness.

2. The closure of claim 1, wherein the closure is a one-piece molding of a thermoplastic elastomer.

3. The closure of claim 1, wherein the main wall, compliant portion, and sealing bead are monolithic.

4. The closure of claim 1, the compliant portion being configured to deflect radially inward during installation on the container and to press the sealing bead against the sealing surface of the container when coupled with the container.

5. The closure of claim 1, wherein the first wall has a radially inward facing surface, and the second wall has a radially outward facing surface, and wherein both the radially inward facing surface and the radially outward facing surface are smooth along a full annular extent of each inward and outward facing surface.

6. The closure of claim 1, further comprising a vent configured to permit gas to escape from a space between the container and the closure during installation on the container such that the vent is sealed off when the closure is coupled with the container.

7. The closure of claim 6, wherein the vent is formed as a groove along an underside of the closure and along an axially and radially extending plane extending through the center of the closure.

8. The closure of claim 6, wherein the vent comprises a radial groove formed along an inner surface of the annular flange.

9. The closure of claim 1, wherein the sealing bead has a direction of extension that forms an acute angle with a longitudinal axis of the container when installed on the container.

10. The closure of claim 1, wherein the sealing bead is in the form of a lip configured to permit gas to escape from a space between the container and the closure during installation on the container and to form a seal with the sealing surface after the gas escapes from said space.

11. The closure of claim 10, wherein the sealing bead is changeable between a downward position, in which the sealing bead has a direction of extension that forms an obtuse angle with a longitudinal axis of the closure, and an upward position, in which the direction of extension forms an acute angle with the longitudinal axis, the lip being configured to permit gas to escape from said space in the upward position.

12. A package comprising a glass container and the closure of claim 1 coupled with and forming a liquid-tight seal with the glass container.

13. A food package according to claim 12.

14. The closure of claim 1, the annular flange being configured to cover at least a portion of a finish of the container when the closure is installed on the container, wherein the sealing bead forms a seal with a radially inward facing sealing surface of the container when installed on the container.

15. The closure of claim 1, wherein the compliant portion defines a single U-shaped cross section between the center of the closure and the annular flange of the closure.

16. The closure of claim 1, wherein the main wall of the closure and the base wall of the annular flange are coplanar.

17. The closure of claim 1, wherein the connector portion of the compliant portion of the closure is a continuously curving bight.

18. The closure of claim 1, wherein at least a portion of the main wall is on an opposite side of an axial datum from the compliant portion, the axial datum being defined along a lower surface of the base wall where the closure bottoms out on the container when coupled with the container.

* * * * *